United States Patent [19]

DeLano et al.

[11] Patent Number: 4,595,203

[45] Date of Patent: Jun. 17, 1986

[54] PUZZLE READING DEVICE

[76] Inventors: Arthur D. DeLano, P.O. Box 2065, Battle Creek, Mich. 49016; Truman H. Langs, Jr., 287 Timber La., Battle Creek, Mich. 49017

[21] Appl. No.: 623,813

[22] Filed: Jun. 21, 1984

[51] Int. Cl.[4] ..... A63F 9/00

[52] U.S. Cl. ..... 273/148 R; 33/562; 33/563; 273/153 R; 434/121

[58] Field of Search ..... 273/148 R, 153 R; 33/174 B, 562, 563, 564, 565, 566; 434/121

[56] References Cited

U.S. PATENT DOCUMENTS

| | | | |
|---|---|---|---|
| D. 136,655 | 11/1943 | Eilert | 33/174 B UX |
| 598,889 | 2/1898 | Young . | |
| 1,642,424 | 9/1927 | Massey | 273/153 R |

FOREIGN PATENT DOCUMENTS

| | | | |
|---|---|---|---|
| 1442375 | 5/1966 | France | 434/121 |
| 12693 | of 1897 | United Kingdom | 273/155 |

OTHER PUBLICATIONS

"Teleword", TV Channels, The Washington Post, Jun. 17, 1979, p. 27.

*Primary Examiner*—Anton O. Oechsle

*Attorney, Agent, or Firm*—Flynn, Thiel, Boutell & Tanis

[57] ABSTRACT

A puzzle reading device is made from a plate having a number of intersecting diametrical elongated windows. When the puzzle reading device is placed over a word search puzzle, words hidden in horizontal, vertical or diagonal rows of the puzzle can be more readily identified. In a preferred embodiment, the puzzle reading device comprises a plurality of stacked discs each defining one or more of the windows, whereby the windows can be adjusted by relative rotation of the discs.

18 Claims, 11 Drawing Figures

PUZZLE READING DEVICE

FIELD OF THE INVENTION

This invention relates to a puzzle reading device adapted for reading well-known word search puzzles wherein a plurality of words or other expressions are hidden in an otherwise meaningless array of letters. The present invention particularly provides a puzzle reading device having window means specifically designed for finding hidden words disposed vertically, horizontally or diagonally within the word search puzzle.

BACKGROUND OF THE INVENTION

Word search puzzles have been known for many years and are currently very popular. A typical variety of this puzzle comprises a sheet of paper having a square or rectangular matrix (array) of letters printed thereon. At first glance, the matrix appears to comprise a meaningless random arrangement of letters. However, within the matrix are a number of identifiable expressions, usually words, which can be identified if the puzzle is read carefully. These words are usually defined by a series of consecutive letters which appear within a horizontal, vertical or diagonal row of the matrix. The words may appear in an unusual order, such as from top to bottom, bottom to top and/or right to left, in addition to the normal left to right.

U.S. Pat. No. 1,642,424 discloses an early version of a word search puzzle wherein a stencil having a rectangular window therein is used to aid in reading the puzzle. The present invention pertains to an improved puzzle reading device for solving a word search puzzle wherein the window is specifically designed for isolating portions of at least two different rows of the array of letters in order to allow the reader to more readily view those rows, and in certain embodiments, to provide a stencil which aids the reader in circling any words found.

A further object of the present invention is to provide an improved word search puzzle wherein a specially designed puzzle reading device is used to view the matrix of letters having expressions hidden therein.

An additional object of the present invention is to provide an adjustable puzzle reading device wherein the shape of the window can be changed to accommodate different spacing of commercially available word search puzzle arrays.

Other objects and purposes of this invention will be apparent from the following specification and accompanying drawings.

SUMMARY OF THE INVENTION

In accordance with the foregoing objects, the invention provides a puzzle reading device adapted for aiding in the solution of a word search puzzle. The puzzle reading device of the present invention is applied to a sheet having a matrix or array of letters thereon, the letters being arranged so that, as an entirety, the matrix of letters appears meaningless. However, the matrix contains therein a limited number of identifiable expressions which correspond to a predetermined meaningful definition, such as English words. Each of the expressions is defined by a series of consecutive letters in a horizontal, vertical or diagonal row of letters within the matrix. As referred to herein, "horizontal row" refers to rows of letters extending from left to right on a puzzle sheet, and "vertical row" refers to rows of letters extending from top-to-bottom on the puzzle sheet.

The puzzle reading device according to the invention comprises a plate having means defining a plurality of intersecting diametrically extending, elongated windows in said plate. Each of these windows corresponds generally in size and shape to the expressions within the matrix of letters such that the expressions can be viewed through the windows distinctly from letters in adjacent rows of the matrix.

The present invention further provides a puzzle which comprises a sheet having a matrix of letters thereon, as described above, in combination with a puzzle reading device having means defining a window therein, as described above. In addition, the invention embraces a method of solving a word search puzzle which comprises moving a puzzle reading device or stencil over the matrix of letters so that the letters appear through the windows, and then marking or selecting the expressions as each of the expressions appear in the window.

DETAILED DESCRIPTION

Figure 1:
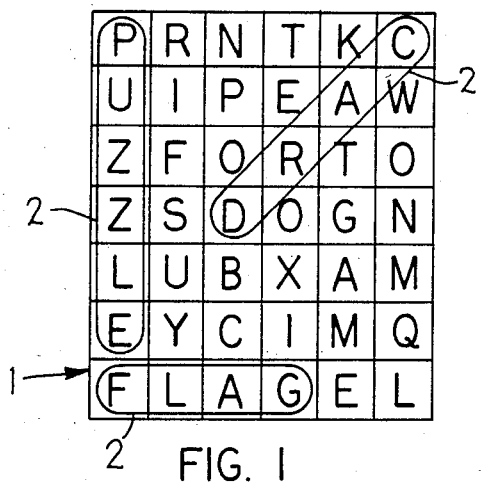
FIG. 1 is a plan view of a word search puzzle array according to the present invention.

FIG. 1 illustrates a sheet 1 having a matrix or array of letters thereon wherein words 2 such as "puzzle", "flag" and "card" are hidden in the array. When found using the stencil according to the present invention, the words 2 above are circled, typically in pencil, to mark the words as shown in FIG. 1. The matrix of letters shown in FIG. 1 is for illustrative purposes only and is smaller than those conventionally used in word search puzzles.

Figure 2:
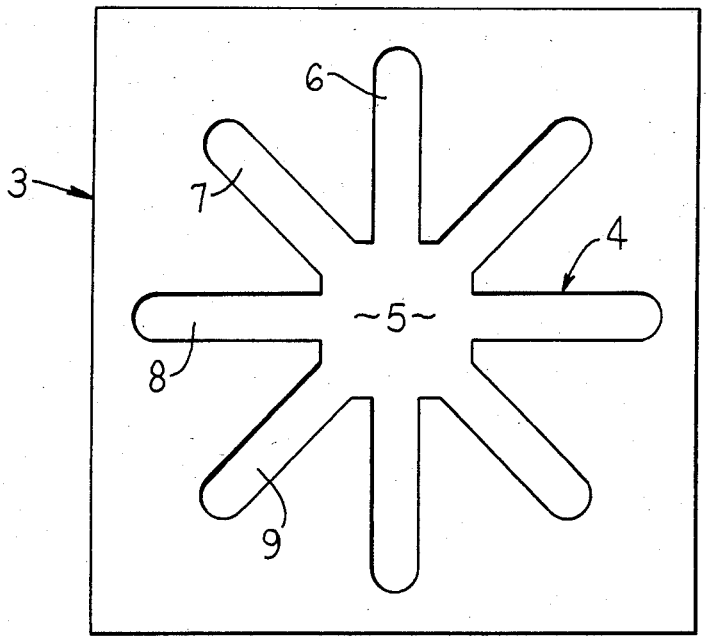
FIG. 2 is a plan view of a puzzle reading stencil according to the present invention.

FIG. 2 illustrates a basic embodiment of a nonadjustable puzzle reading stencil 3 according to the invention having an opening 4 therein. The opening 4 includes a central, essentially square or rectangular opening portion 5. Four diametrically extending, elongated slots 6, 7, 8 and 9, defining the windows of the present invention, intersect at the center of the opening 4, and the intersection thereof defines the central opening portion 5. The slots 6 and 8 are disposed at right angles to each other to facilitate reading of the horizontal and vertical rows of the matrix of letters. The slots 7 and 9 are formed at a selected angle relative to the slots 6 and 8 so that the slots 7 and 9 can be used to read diagonal rows of letters of the matrix while the slots 6 and 8 can be used to read a row running from top to bottom and a row running from side to side, respectively. In the embodiment shown in FIG. 2, the slots 7 and 9 are mutually perpendicular to each other, and each of the slots 7 and 9 defines a 45° radial angle relative to the adjoining slots 6 and 8. The overall size of the stencil 3 corresponds to the size of the matrix of letters. Typically, the central opening portion 5 will be essentially square, and each dimension thereof will be three times greater than the width of the slots 6, 7, 8 and 9. In such a case, a 3×3 array of letters is viewed through the opening portion 5, and a single horizontal, vertical or diagonal row of letters is visible through each of the corresponding slots 6, 7, 8 and 9. The slots 6, 7, 8 and 9 preferably have an essentially uniform width in the range of 0.1 to 1 inches, more preferably 0.15 to 0.25 inches.

Figure 3A:
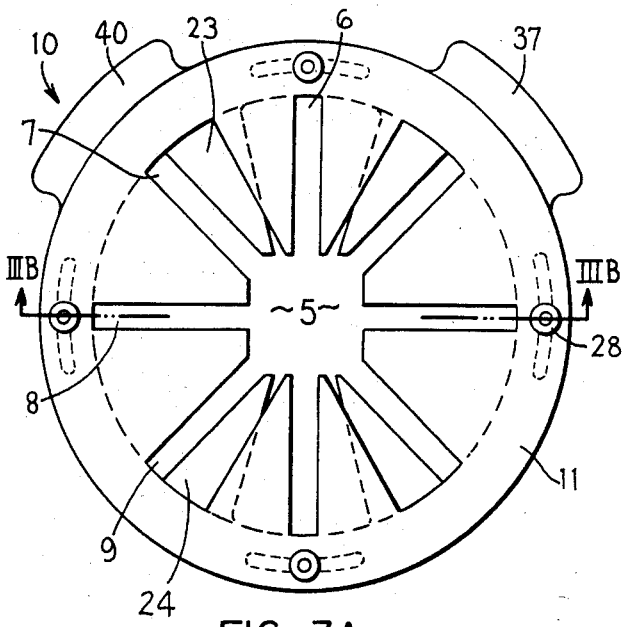
FIG. 3A is a plan view of a first embodiment of an adjustable puzzle reading stencil according to the present invention.
Figure 3B:
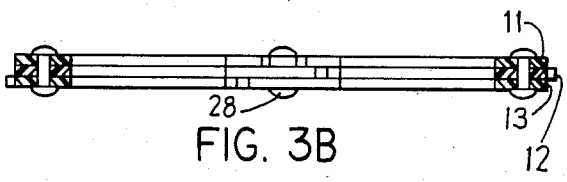
FIG. 3B is a cross-sectional view taken along the line IIIB—IIIB in FIG. 3A.

FIGS. 3A, 3B, 4A, 4B and 4C illustrate a further embodiment of the invention wherein the stencil is adjustable to accommodate arrays of letters of different sizes. The adjustable stencil 10 shown in FIG. 3A comprises a series of stacked discs 11, 12 and 13, which are individually shown in FIGS. 4A, 4B and 4C, respectively. The first disc 11 comprises an outer ring-shaped portion 14 having eight radially inwardly extending projections 15, 16, 17, 18, 19, 20, 21 and 22 formed thereon. Each of the projections 15 through 22 is essentially sectorial in shape, but the radially innermost ends thereof are trimmed appropriately to form the central opening portion 5. In the preferred embodiment shown, the pairs of projections 15, 16 and 19, 20 define the slot 6, and the pairs of projections 17, 18 and 21, 22 define the slot 8 therebetween. In addition, the projections define therebetween two enlarged diametrical slots 23 and 24 which are greater in width than the slots 6 and 8. In the assembled stencil as shown in FIG. 3A, the enlarged radially extending slots 23 and 24 define the limits of the angular range through which the slots 7 and 9 can be adjusted, as will be described below. As shown in FIGS. 3A and 3B, four fasteners 28, such as rivets, are used to hold the discs 11, 12 and 13 in a coaxially stacked, face-to-face relationship. The fasteners extend through holes 27 in the ring-shaped portion 14 of the first disc 11.

Figure 4C:
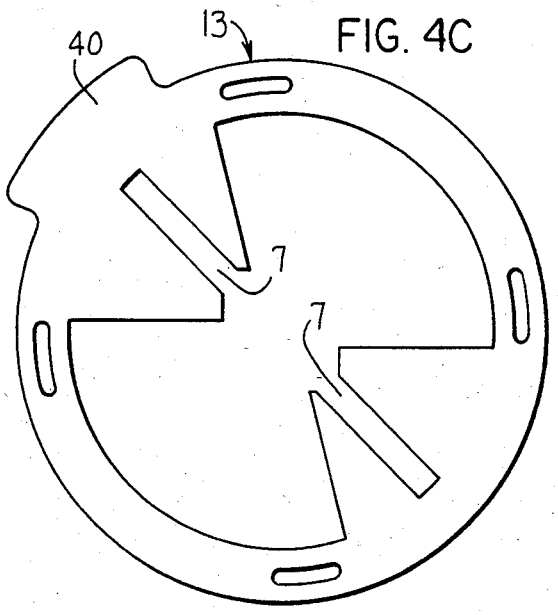
FIGS. 4A, 4B and 4C are plan views of the three discs that are stacked together to form the stencil shown in FIGS. 3A and 3B.
Figure 4A:
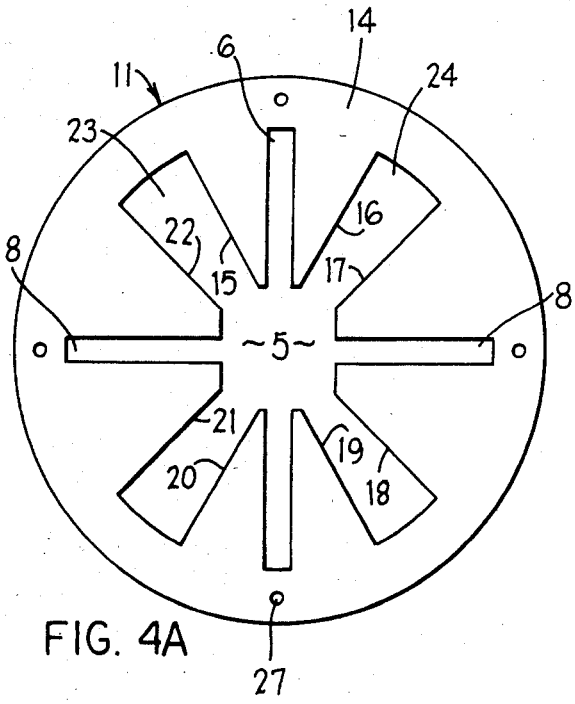
Figure 4B:
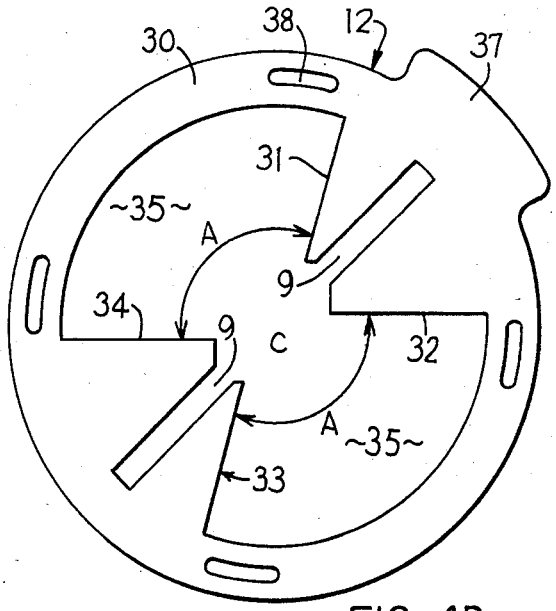

As shown in FIG. 4B, the second disc 12 comprises an outer ring-shaped portion 30 having four radially inwardly extending projections 31, 32, 33 and 34 formed thereon. The projections 31–34 are essentially sectorial in shape, like the projections shown in FIG. 4A. The pairs of projections 31, 32 and 33, 34, respectively, define the end portions of the slot 9 therebetween. The pairs of projections 31, 34 and 32, 33 each additionally define a large slot 35 therebetween. Unlike the slots 23 and 24 of the disc 11, the radially extending edges of which define radial acute angles, the radially extending edges of the slot 35 define an obtuse radial angle relative to the center C of the disc 12. In the embodiment shown, each of the slots 35 defines a central radial angle A of about 110°. The outer ring-shaped portion 30 of the second disc 12 additionally has a radially outwardly extending tab 37 by which the user can rotate the disc 12 relative to the discs 11 and 13. The outer ring-shaped portion 30 further has a series of four elongated slots 38 within which the fasteners 28 slide in the circumferential direction of the disc 12 when the disc 12 is rotated relative to the discs 11 and 13.

The third disc 13, in the embodiment shown in FIG. 4C, is identical to the second disc 12, but defines the slot 7 instead of the slot 9. A tab 40 formed on the outer periphery of the third disc 13 performs the same function as the tab 37 on the second disc 12.

When the discs 11, 12 and 13 are stacked coaxially and face-to-face as shown in FIG. 3A, the stencil 10 can be adjusted by means of the tabs 37 and 40. When the tab 40 is moved in the circumferential direction of the substantially circular stencil 10, the position of the slot 7 can be adjusted such that the slot 7 can be moved between either edge of the larger slot 23. Similarly, the tab 37 can be used to adjust the position of the slot 9 within the range allowed by the width of the slot 24. In this way, the user can adjust the angles of the slots 7 and 9 relative to the slots 6 and 8 to match the dimensions and arrangement of the array of letters. Frequently, the letters in the array are not spaced apart the same distance side to side as from top to bottom. Thus, the embodiment of FIG. 2 is not always suitable to read diagonal words, since the diagonal words are not always disposed at 45° angles relative to commonly centered top to bottom and side-to-side rows of letters. The embodiment of FIG. 3A thus allows the slots 7 and 9 to be adjusted for arrays wherein diagonal words are not disposed at 45° relative to the top to bottom and side to side rows of the matrix.

FIGS. 5A, 5B, 6A and 6B illustrate a second embodiment of an adjustable puzzle reading device according to the present invention. The puzzle reading device 50 shown in FIG. 5 comprises a pair of coaxially stacked transparent discs 51 and 52, shown in FIGS. 6A and 6B, respectively. The disc 51 has a transparent, diametrically elongated window 53 defined thereon by suitable means, such as a heavy black line or colored rim. The interior of the window 53 can be cut away, providing an elongated slot, or can be left in place, since the window is defined by the dark line. Alternately, if the windows 53, 57 are cut away, the windows 53, 57 can be defined by forming the discs 51, 52 of essentially transparent colored plastic. The disc 51 further has a plurality of holes 54 therein, through which fasteners 55 extend, for joining the discs 51 and 52 together in a face-to-face, coaxial relationship. A tab 56 formed on the outer periphery of the disc 51 facilitates relative rotation of the disc 51 with respect to the disc 52.

The second transparent disc 52 is of the same diameter as the disc 51 and has a diametrical, elongated window 57 therein substantially identical to the window 53. The disc 52 further has a plurality of slots 58 formed near the outer periphery thereof which are elongated in the circumferential direction of the disc 52 and aligned with the holes 54, whereby the fasteners 55 travel within the respective elongated slots 58 when the transparent discs 51 and 52 are rotated relative to each other. The puzzle reading device 50 is not a stencil, and thus must be removed from the page in order for the word located in one of the windows to be circled. The disc 52 has a tab 59 formed on the outer periphery thereof. The user grasps the tabs 56 and 59 in order to rotate the discs 51, 52 relative to each other.

It will be apparent to those skilled in the art that numerous variations of the foregoing embodiments could be constructed. For example, the central opening portion 5 can be increased or reduced in size. In addition, the number of slots in the embodiment shown in FIG. 3A could be reduced from four to two, using only two stacked discs in a manner similar to the embodiment of FIG. 5A.

Figure 5A:
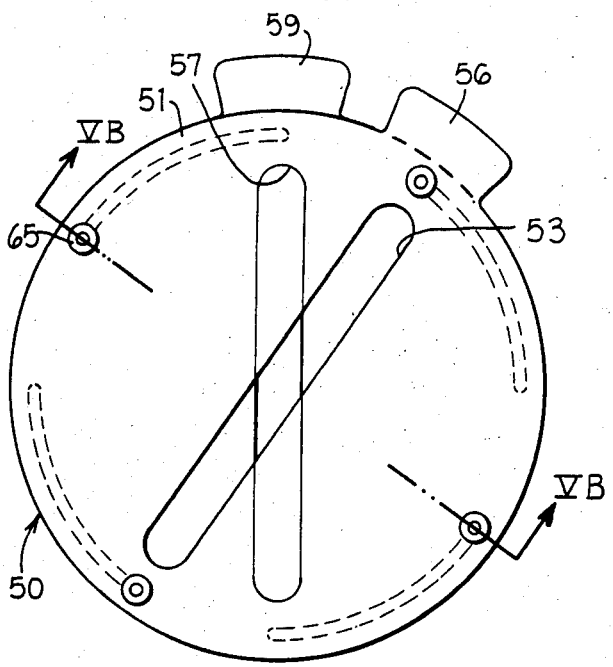
FIG. 5A is a plan view of an adjustable puzzle reading device according to a further embodiment of the present invention.
Figure 5B:
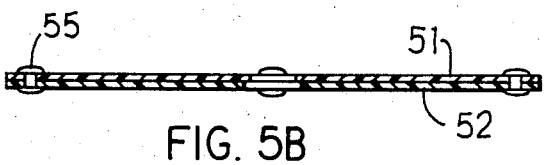
FIG. 5B is a cross-sectional view taken along the line VB—VB in FIG. 5A.
Figure 6A:
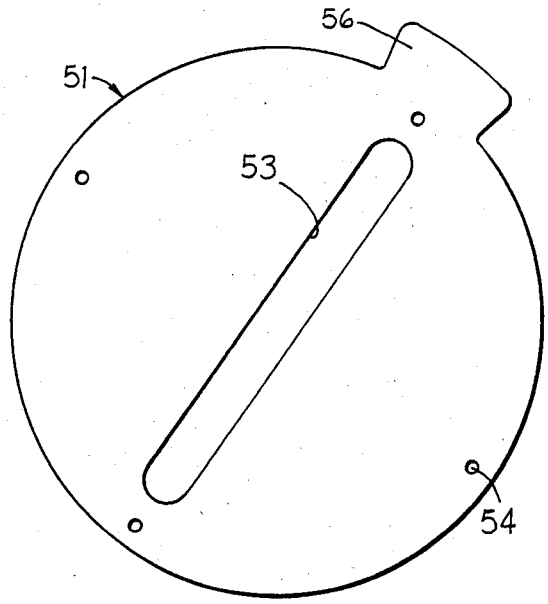
FIGS. 6A and 6B are plan views showing the pair of discs that are stacked together to form the puzzle reading device shown in FIG. 5.
Figure 6B:
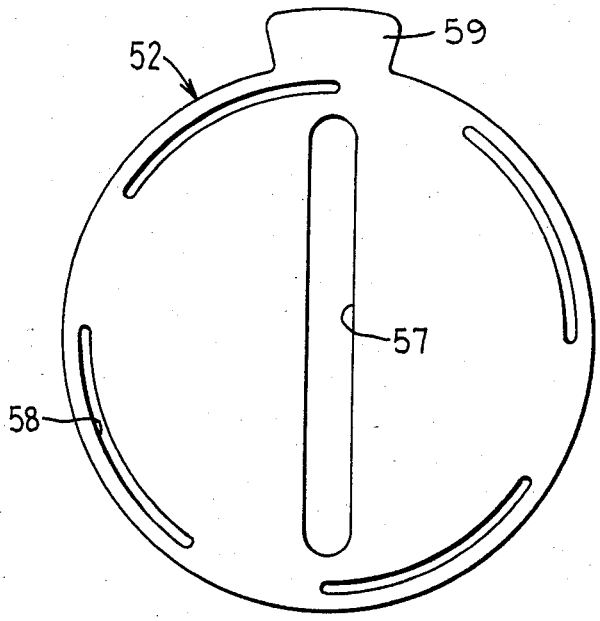

The puzzle reader of FIG. 5A is adjustable such that the radial angle defined between the lengthwise axes of the diametrical windows 53, 57 varies in the range of from 0° to 90°, preferably 20° to 90°. When the foregoing axes are at right angles, the puzzle reader can be used to read the horizontal and vertical rows of the array of letters. An adjustment to a radial angle between the foregoing axes of less than 90° may then be made to read the diagonal rows of the array of letters, if necessary. Although the embodiment shown in FIG. 5A does not allow the user to simultaneously view a horizontal, vertical and pair of corresponding diagonal rows, it can still be used for the purposes of the present invention and is simpler in structure than the device shown in FIG. 3A.

In embodiments of the present invention wherein a plurality of coaxial discs are stacked together, any suitable means may be used to keep the discs in a coaxial, face-to-face relationship. As an alternative to the fasteners shown in the described embodiments, the stacked discs comprising the puzzle reader or stencil can be inserted into a suitably sized envelope or frame having enlarged openings in the front and back thereof corresponding to the window portions of the puzzle reader or stencil.

The puzzle reader or stencil of the present invention can be made of any suitable inexpensive, lightweight material such as cardboard or plastic. For the embodiment shown in FIG. 5, the discs 51 and 52 are typically made of transparent plastic.

It will be apparent to those skilled in the art that many modifications of the disclosed invention, including the rearrangement of parts, lie within the scope of the present invention.

The embodiments of the invention wherein an exclusive property or privilege is claimed are defined as follows:

1. A puzzle reading device adapted for solving a puzzle defined by a sheet having a matrix of letters thereon, said letters being arranged so that, as an entirety, said matrix of letters is meaningless, said matrix however containing therein a limited number of predetermined indentifiable expressions, each of said expressions being defined by a series of said letters within a horizontal, vertical or diagonal row of said matrix, said device comprising a plate having means defining a plurality of diametrical, intersecting, elongated windows in said plate, each of said windows substantially corresponding in size and shape to said expressions such that said expressions can be viewed through said windows distinctly from letters in adjacent rows of said matrix, wherein said plate includes a plurality of coaxial, stacked discs, each of said discs defining at least one of said windows thereon, said device futher including means for rotating said discs relative to each other, thereby rotating said windows relative to each other, and means for holding said discs in said stacked, coaxial relationship, and wherein said discs are transparent and said windows are each defined by a colored border.

2. A puzzle reading device adapted for solving a puzzle defined by a sheet having a matrix of letters thereon, said letters being arranged so that, as an entirety, said matrix of letters is meaningless, said matrix however containing therein a limited number of predetermined identifiable expressions, each of said expressions being defined by a series of said letters within a horizontal, vertical or diagonal row of said matrix, said device comprising a plate having means defining a plurality of diametrical, intersecting, elongated windows in said plate, each of said windows substantially corresponding in size and shape to said expressions such that said expressions can be viewed through said windows distinctly from letters in adjacent rows of said matrix, wherein said windows include an opening in said plate, and wherein said opening includes a central hole in said plate, said hole defining a parallelogram, and a plurality of diametrical, elongated slots which intersect at said hole.

3. A device according to claim 2, wherein said device has four of said slots corresponding in size and shape to horizontal, vertical and diagonal rows of said letters defined by centering said device upon a letter of said matrix.

4. In combination, a puzzle comprising a sheet having a matrix of letters thereon, said letters being arranged so that, as an entirety, said matrix of letters is meaningless, said matrix containing therein a limited number of predetermined identifiable expressions, each of said expressions being defined by a series of said letters within a horizontal, vertical or diagonal row of said matrix, and a puzzle reading device which is a plate having means defining a plurality of diametrical, intersecting, elongated windows in said plate, each of said windows substantially corresponding in size and shape to said expressions such that said expressions can be viewed through said windows distinct from letters in adjacent rows of said matrix, wherein said plate includes a plurality of coaxial, stacked discs, each of said discs defining at least one of said windows thereon, said device further including means for rotating said discs relative to each other, thereby rotating said windows relative to each other, and means for holding said discs in said stacked, coaxial relationship.

5. A puzzle according to claim 4, wherein said discs are transparent and said windows are each defined by a colored border.

6. A puzzle according to claim 4, wherein said windows include open slots in said discs, each of said stacked discs having an enlarged opening therein whereby each of said slots can be seen through from front and back faces of said device through a range of relative rotations of said discs.

7. In combination, a puzzle comprising a sheet having a matrix of letters thereon, said letters being arranged so that, as an entirety, said matrix of letters is meaningless, said matrix containing therein a limited number of predetermined indentifiable expressions, each of said expressions being defined by a series of said letters within a horizontal, vertical or diagonal row of said matrix, and a puzzle reading device which is a plate having means defining a plurality of diametrical, intersecting, elongated windows in said plate, each of said windows substantially corresponding in size and shape to said expressions such that said expressions can be viewed through said windows distinct from letters in adjacent rows of said matrix, wherein said windows include an opening in said plate, and wherein said opening includes a central hole in said plate, said hole defining a parallelogram and a plurality of diametrical, elongated slots which intersect at said hole.

8. A puzzle according to claim 7, wherein said device has four of said slots corresponding to size and shape to horizontal, vertical and diagonal rows of said letters defined by centering said device upon a letter of said matrix.

9. A puzzle reading device adapted for solving a puzzle defined by a sheet having a matrix of letters thereon, comprising two plates which are parallel and adjacent each other and which are supported for relative rotation about a common axis which extends perpendicular to said plates, each said plate having means defining an elongate, substantially straight window thereon which intersects said axis of rotation, relative rotation of said plates effecting angular movement of said windows relative to each other; wherein each said plate is made of a transparent material, and wherein each said window is defined by a colored border provided on a respective said plate.

10. A puzzle reading device adapted for solving a puzzle defined by a sheet having a matrix of letters thereon, comprising two plates which are parallel and adjacent each other and which are supported for relative rotation about a common axis which extends perpendicular to said plates, each said plate having means defining an elongate, substantially straight window thereon which intersects said axis of rotation, relative rotation of said plates effecting angular movement of said windows relative to each other, wherein each said plate is made of a substantially transparent colored material, each said window being defined by an elongate slot provided in a respective said plate.

11. A puzzle reading device adapted for solving a puzzle defined by a sheet having a matrix of letters thereon, comprising two plates which are parallel and adjacent each other and which are supported for relative rotation about a common axis which extends perpendicular to said plates, each said plate having means defining an elongate, substantially straight window thereon which intersects said axis of rotation, relative rotation of said plates effecting angular movement of said windows relative to each other; wherein one said plate has a plurality of angularly spaced arcuate slots which are each concentric with said axis of rotation, and wherein the other of said plates has a plurality of angularly spaced, axially extending pins thereon which are each slidably received in a respective one of said arcuate slots.

12. The device according to claim 11, wherein said plates are circular discs of substantially equal diameter and each have a radially outwardly projecting tab on a peripheral edge thereof.

13. A puzzle reading device adapted for solving a puzzle defined by a sheet having a matrix of letters thereon, comprising: first, second and third parallel, stacked plates, means supporting said plates for rotation about a common axis independently of each other, and means for limiting rotation of said second and third plates relative to said first plate; wherein said first plate has four elongate narrow first slots which extend radially outwardly from said axis at angularly spaced intervals, a first diametrically opposed pair of said first slots being substantially perpendicular to a second diametrically opposed pair of said first slots, said first plate further having between each circumferentially adjacent pair of said first slots a first opening which extends radially outwardly from said axis; wherein said second plate has two elongate narrow second slots which extend radially outwardly from said axis in diametrically opposite directions and which are each aligned in all angular positions of said second plate with a respective one of said first openings in said first plate, said second plate further having two diametrically opposed second openings which extend radially outwardly from said axis and are angularly spaced from said second slots, each said second opening having aligned therewith in all relative angular positions of said first and second plates two angularly adjacent said first slots and the first opening therebetween; and wherein said third plate includes two elongate, narrow third slots which extend radially outwardly from said axis in diametrically opposite directions and which are each aligned in all angular positions of said third and first plates with a respective one of said first openings in said first plate, said third plate further including two diametrically opposed third openings which extend radially outwardly from said axis and are angularly spaced from said third slots, each said third opening having aligned therewith in all relative angular positions of said first, second and third plates two angularly adjacent said first slots, the first opening therebetween, and a respective one of said second slots.

14. The device according to claim 13, wherein each of said plates has therein a square hole which has a center substantially coincident with said axis, wherein said first, second and third slots each have substantially the same width, wherein the length of each side of each said square hole is approximately three times the width of said slots, and wherein each of said first, second and third openings is substantially sector shaped and has a center point which is coincident with said axis of rotation.

15. The device according to claim 14, wherein each of said plates is a circular disc, wherein said second and third discs each have a plurality of angularly spaced arcuate slots therein which are concentric with said axis, wherein said device includes a plurality of pins which each extend through a hole provided in said first plate and through a respective one of said arcuate slots in each of said second and third plates, and wherein said second and third plates each have thereon a tab which extends radially outwardly from a peripheral edge thereof, said tabs being angularly spaced from each other.

16. A puzzle, comprising a sheet having thereon a matrix of letters, and a device for selectively viewing letters from said matrix, said device including a plate having means defining four elongate first window portions which each extend radially outwardly from a center point at locations spaced angularly by 90°, and means defining four elongate second window portions which extend radially outwardly from said center point at angularly spaced locations, each said second window portion being located angularly between a respective pair of said first window portions, each of said second window portions being diametrically opposite a further said second window portion.

17. The puzzle according to claim 16, wherein each of said first and second window portions is defined by a respective slot provided through said plate, and wherein said plate has a square hole therethrough which has a center coincident with said center point, said slots having substantially equal widths and the length of each side of said square hole being approximately three times the width of said slots.

18. The puzzle according to claim 17, wherein each of said second window openings is spaced angularly by 45° from each said first window portion adjacent thereto.

* * * * *